United States Patent [19]

Fisher

[11] 4,381,739

[45] May 3, 1983

[54] CAM INTERNAL COMBUSTION ENGINE

[76] Inventor: Patrick T. Fisher, 2005 S. Cooper, Arlington, Tex. 76010

[21] Appl. No.: 269,268

[22] Filed: Jun. 1, 1981

Related U.S. Application Data

[62] Division of Ser. No. 102,313, Dec. 10, 1979, abandoned.

[51] Int. Cl.[3] ..... F02B 75/26

[52] U.S. Cl. ..... 123/54 B; 74/53; 123/56 BB; 123/56 C; 123/197 R

[58] Field of Search ..... 123/54 R, 54 B, 56 R, 123/56 A, 56 B, 56 C, 56 BB, 56 BA, 58 R, 58 A, 58 AM, 58 AA; 74/567, 569, 53, 54

[56] References Cited

U.S. PATENT DOCUMENTS

| | | | |
|---|---|---|---|
| 2,417,648 | 3/1947 | Johansen et al. | 123/197 R |
| 3,610,218 | 10/1971 | Durham | 74/53 |
| 3,998,200 | 12/1976 | Sudholt | 123/197 R |
| 4,274,364 | 6/1981 | Gerber et al. | 123/52 A |

FOREIGN PATENT DOCUMENTS

| | | | |
|---|---|---|---|
| 2042632 | 3/1972 | Fed. Rep. of Germany | 123/54 R |
| 283053 | 2/1931 | Italy | 123/197 |

*Primary Examiner*—Craig R. Feinberg

[57] ABSTRACT

In an internal combustion engine, a combination of cylinders, pistons, rods, beams, gears and cams that are used for converting the reciprocating motion of the pistons into rotary motion of the drive shaft. One embodiment includes a block member that is fastened to four opposed in-line cylinders, that contain pistons that are attached to the ends of connecting rods and the opposite ends of the rods being attached to roller bearings and to the ends of two rocker beams. The beams, that oscillate in the same plane side by side, each have a separate shaft passing through their centers which are supported by the block member. Located at each of the two ends of the two rocker beams, there is a cam with shaft, that is placed between two of the roller bearings, and these two cams are connected by gears that cause the two cams to rotate in the proper position in relation to each other for the proper engagement of the cams bearing surfaces with the roller bearings. In an alternate embodiment, two rocker levers, which also pivot from their centers, have at one end a main cam with shaft and at the opposite end is placed a cylinder supporting two opposed pistons that are also between the ends of one end of the rocker levers. The improved features of construction includes a gear attached to the shaft of the main cam and this gear engages two gears placed opposite the main cam shaft gear, and connected to these two gears are shafts which are placed at the outer sides of the rocker levers. The shafts of the two outer gears have cams which are attached to them that engage the outer edges of the rocker levers and/or the rollers, urging the rollers attached to the ends of the rocker levers to make contact with the main cam.

1 Claim, 2 Drawing Figures

CAM INTERNAL COMBUSTION ENGINE

This application is a division of application Ser. No. 102,313, filed Dec. 10, 1979, now abandoned.

SUMMARY OF THE INVENTION

This invention is in relation to internal combustion engines. It is an object of this invention to provide a kinematic linkage for use in the internal combustion engine, which is superior and will replace the conventional crankshaft, other possible cam designs, and the gas turbine engine. Another object of this invention is to provide a better combined overall performance in relation to better fuel economy, less manufacturing cost, less repair and maintenance coat, less required cooling, less air pollution and a better vibrant balance. The various objects will become apparent as the description proceeds, such description being made with reference to the accompanying drawings for a part of the specification.

DETAILED DESCRIPTION

Numerous patents have been issued on the cam or the irregular shaped disk plate internal combustion engine. The reasons for optimism in relation to the cam engine has been because of: the merits of the cam mechanism that allows for low shaft speeds without the sacrifice in engine horsepower; elimination of valve-cam operating gears, reduction gears and counterweights; simple construction for the use of anti-friction bearings; and in many designs reduced piston friction. The first successfully tested cam engine is written about in the article "The Development and Technical Aspects of the Fairchild Caminez Engine," Am. Soc. Mech. Engineers, 1927–28, AER-50-9. Mr. H. Briggs patented, in U.S. Pat. No. 1,505,856, the concept of permitting the rest of the piston at the top center during movement of the crankshaft. The limited use of this concept in his application produced some gain in efficiency which was off-set to a large extent by his cam design which produced low air turbulance. Written about three years later in the article Aviation, Nov. 7, 1927, 1115, quote "The engineers of the Fairchild Caminez Engine Corp. also claim that the piston motion obtained by the cam mechanism produces a more efficient cycle than the crank mechanism in an internal combustion engine." Utilizing the cam design, in the regulating of the piston movement, for promoting an efficient engine has only recently been under serious consideration, and will soon prove to be the most important factor in relation to efficiency in the internal combustion engine. The engine described in Science and Mechanics, Fall 1979, 39, will soon be undergoing tests. The cam designs that the inventor has drawn take in consideration all the necessary aspects which will promote a more fuel efficient and better performance engine. Cam engines in the past have come very close to permanent use in commercial applications, but for various reasons have not been successful. The main problems in relation to cam engines have been a means for maintaining the connecting rod rollers in contact with the cam surfaces, expense, piston friction and balance; also in the swash plate engines the roller bearings making contact with the cams wear very rapidly and the using of slider bearings causes much friction. This invention has eliminated all the problems mentioned above.

Figure 1:
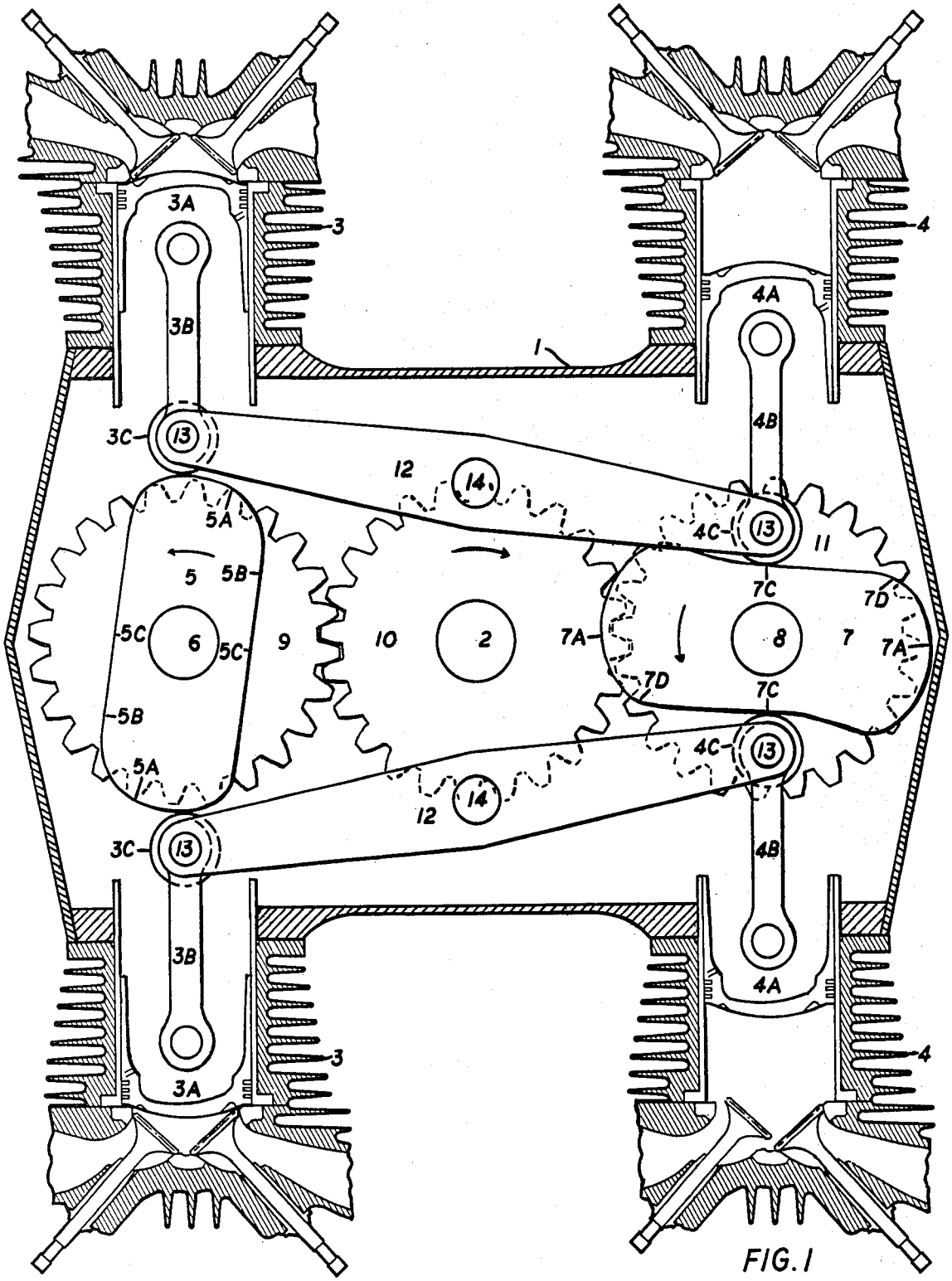
FIG. 1 is a front sectional view of an internal combustion engine in which there are four opposed cylinders and pistons, two rocker beams that are placed side by side and two main cams with their shafts being connected by means of three gears.

In FIG. 1, there is shown the invention which is a kinematic linkage which is a part of a four-stroke internal combustion engine. U.S. Pat. No. 1,630,273 discusses some ideas which are closely related to FIG. 1. The engine in the patent application above would have been a success except for the problem of balance in the swing arms. In FIG. 1, reference numeral 1 identifies an engine block member carrying a central rotatable drive shaft 2 which is placed between two pair of opposed cylinders, 3 and 4, which are placed in line and mounted on and projecting outwardly from the block 1. The cylinders 3 and 4 contain pistons 3A and 4A which are attached to the ends of the connecting rods 3B and 4B which carry roller bearings 3C and 4C on their opposite ends. The rollers 3C are engaging the convex curved bearing surfaces 5A on the opposite ends of the cam 5 which is supported by the shaft 6 which is carried by the block 1, and the rollers 4C are engaging the generally straight bearing surfaces 7C on the opposite sides of the cam 7 which is supported by the shaft 8 which is carried by the block 1. The shafts 6, 2 and 8 are in line and connected by in line gears 9, 10 and 11. The rollers 3C and 4C are attached to the ends of the beams 12 by means of the pins 13 which may preferably have needle bearings around them making contact with the rollers 3C and 4C. Connected to and passing through the centers of oscillating beams 12 are the shafts 14 which are supported by the block 1. In describing the operation of the engine, the roller bearings 3C are shown holding the pistons 3A at top center position, and the rollers 4C which are making contact with the bearing surfaces 7C are shown holding the pistons 4A at the bottom of the stroke position. As the cam 5 rotates from shown position, the rollers 3C roll over the bearing surfaces 5A toward the generally straight bearing surfaces 5B. When the rollers 3C have rolled to the bearing surfaces 5B, then the rollers 4C would have rolled to the bearing surfaces 7D. In the final movement of this stroke, the rollers 3C will roll to the generally straight bearing surfaces 5C, while the rollers 4C will roll to the convex curved bearing surfaces 7A, thereby moving the pistons 3A to the bottom of the stroke, and the pistons 4A to the top position of the stroke. The completion of the next stroke will move said moving parts back to the positions shown in the drawing. The curved bearing surfaces 5A and 7A are designed to move the pistons 3A and 4A to within 1/5 of the beginning of the length of the combustion stroke during approximately two times as long a time period for each combustion cycle in comparison to the conventional crankshaft. Likewise, the bearing surfaces 7C and 5C will move the pistons 3A and 4A to within 1/5 of the beginning of the length of the compression stroke for about two times as long a time during each compression cycle in comparison to the conventional crankshaft. The pistons 3A and 4A speed will correspond during the last 4/5 of the distance of the compression and expansion strokes, and the speed will be about ¼ faster per cycle in comparison to the conventional crankshaft piston speed. The cams 5 and 7 have their bearing surfaces designed to meet the applications of most of the various varieties of the four-stroke and two-stroke internal combustion engines in which fuel efficiency and engine performance are of the main concern. The pistons 3A and 4A will move in comparison to the conventional crankshaft in such a way as to permit a longer time for combustion to occur while the pistons 3A and 4A are at the top of the stroke. Also after combustion occurs, the pistons 3A and 4A will move faster during expansion. This will give less time for the heat of combustion to escape through the walls of the cylinders. Because the pistons 3A and 4A dwell at the bottom of the stroke longer, this will promote a longer time for scavaging the cylinders. Also because the pistons 3A and 4A speed is faster at the end of the compression stroke in comparison to the conventional crankshaft, the air-turbulence will be greater; thereby promoting a more rapid combustion. When using the otto cycle, the FIG. 1 embodiment, which is designed for high performance engines, will improve the fuel economy, in comparison to the conventional crankshaft, about two times. For very small engines, the above figure will be higher, and for very large engines this figure will be smaller. Some improvements in fuel economy are: cars 2½ times or more, piston aircraft 2 times, gas motor boats 2 or more times, gasoline engines 1½ to 3 times, diesel engines 1-1/10 to 1½ times, and diesel truck 1-6/10 times. In FIG. 1, opposing cylinders 3A and 4A have excellent vibrant balance, and this, also, would apply if only using two cylinders 3A or 4A per engine. The pistons 3A and 4A move with the rods 3B and 4B at only a very slight angle from a parallel position with cylinders 3 and 4. The friction of the pistons 3A and 4A is very small or less than 1%. The gears 9, 10 and 11 may be designed to reduce the R.P.M. of the shaft 2 several times. Also there may be only two connecting gears 9 and 11 to operate an engine. A feature which may be advantageous for some commercial applications is shown in U.S. Pat. No. 1,817,375, whereby gears are used as a means for minimizing the slippage between the rotatable cam and its roller followers. A suggested method of manufacturing the original prototype cams is to use cam 5 as a main base cam 5 and to replace bearings 4C with grinding wheels, then as cam 7 is being ground, the cam 5 will act as a guide. If desired, there may be three cams used in place of one cam 5 or 7. In this case, the center cam will support one roller bearing 3C or 4C, and the two outside cams may support, on their opposite sides or ends, two roller bearings 3C or 4C. Each cylinder 3 and 4 may be replaced with two V-type arrangement cylinders. FIG. 1 may operate with only one beam 12 along with one or more cylinders.

Figure 2:
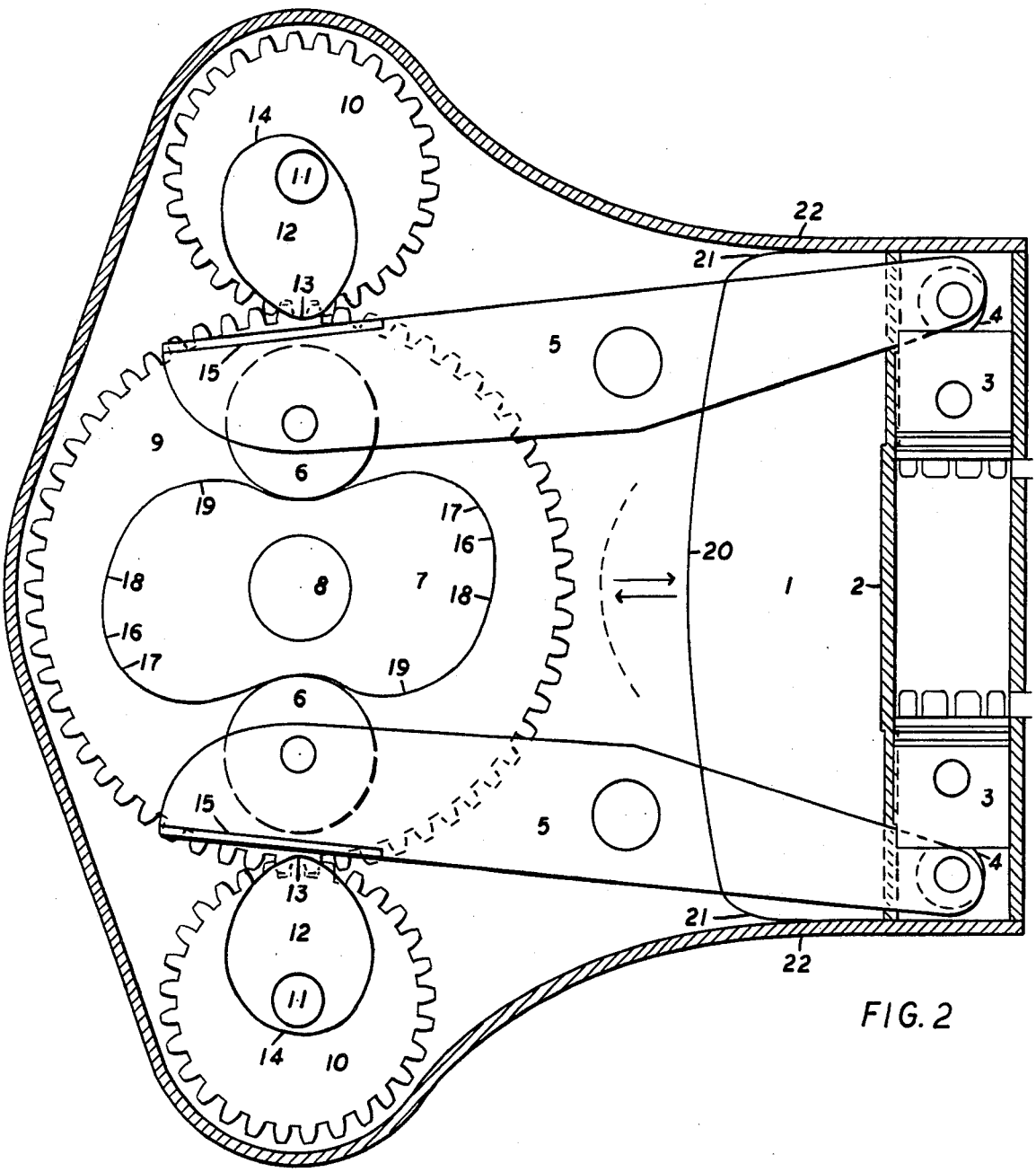
FIG. 2 is a front sectional view illustrating an alternate embodiment which is a two-stroke cycle internal combustion engine.

In FIG. 2, there is shown an alternate embodiment which is a part of a two-stroke internal combustion engine in which low pistons 3 speeds are desired and medium pistons 3 speed may be applied. FIG. 2 has the advantage of lower repair cost than FIG. 1. Not including the improved features shown, this internal combustion engine has had limited use, and it has been developed by the Svanemolle Wharf Co. of Copenhagen, Denmark, for marine and stationary applications. "An advantage claimed for the construction is that it gives a very compact engine of low output speed which, moreover, is free from torsional vibration." A drawing of the engine which was developed by the Svanemolle Wharf Co. is given in the reference Heldt, "Two-Stroke Diesel Has No Crankshaft," Auto. Ind., June 15, 1955. In FIG. 2, there are shown the main features which are described in the reference above which are a block member 1, a cylinder 2, the pistons 3, the connecting rods 4, the rocker levers 5, the rocker-lever rollers 6, the main cam 7, and the main cam shaft 8. In FIG. 2, the improved features of construction comprises of a gear 9, attached to the main cam shaft 8, two smaller diameter gears 10 which are placed at opposite sides of and connected to the gear 9, the shafts 11 which are fastened to the gears 10 and are supported by the block member 1, the cams 12 which are attached to the shafts 11, and the cam plates 15. The improved features are designed for the purpose of urging the rollers 6 to make contact with the main cam 7. As shown in FIG. 2, the pistons 3 are at the bottom of the expansion stroke. As the main cam 7 with the gear 9 rotates, then the gears 10, which are connected to gear 9, will also have to rotate; thereby rotating the cams 12 which will make contact with the cam plates 15 which urge the rollers 6 to make contact with the main cam 7. Before the end of the expansion stroke and at the beginning of the compression stroke, the inertia forces of the oscillating parts will urge rollers 6 to make contact with cam 7; therefore the convex curved ends 13 of the cams 12 may then be spaced away from the cam plate 15. When the pistons 3 have completed the compression stroke and are at the top center position, then the convex curved ends 16 of the main cam 7 will make contact with the rollers 6; and the curved ends 14 of the cam 12 will make contact with the cam plate 15. The improved features, which will permit the use of an otto or diesel cycle, will prevent the problem of the pistons 3 from dwelling at top center position by means of a vacuum during the starting of the engine; and after starting, the engine may operate at medium pistons 3 speeds. For medium pistons 3 speeds the wear on the cams 12 and cam plate 15 must be taken into consideration because the higher the pistons 3 speeds then the greater the forces of contact between the cams 12 and the cam plate 15. The wear and frictional losses are especially important during the completion of the compression stroke. The cam surfaces 17 are designed to give a slower pistons 3 compression speed in relation to the pistons speed of compression of FIG. 1, in order to prevent excess wear and friction on the cams 12. The curve cam surfaces 18 are designed to keep the pistons 3 to within 1/5 of the top of the combustion stroke for over two times as long a period in comparison to the conventional crankshaft. The cam surfaces 19 will allow the pistons 3 speed of expansion to be faster in comparison to the conventional crankshaft. When FIG. 2 is used with crankcase compression, then the cylinder 2 could be sealed off by a polyurethane rubber 20 that may be reinforced. The rectangular-shaped rubber 20 is thin and flexible, and may be used as a diaphragm by means of making use of the oscillating motion of the levers 5, thereby causing a suction and compression of the air-fuel mixture in the crankcase. The outer ends 21 of the rubber 20 are fastened to the outer covering 22 of the block 1. When used commercially for the proper applications, the fuel economy of the FIG. 2 embodiment will be about the same as the FIG. 1 embodiment. The FIG. 2 embodiment is desirable for non-commercial application when low or medium pistons 3 speeds are required. FIG. 2 may have one or more cylinders added to or used without the cylinder 2 arrangement. When using only one cylinder with piston, then only one rocker lever 5, shaft 11, cam 12, and gear 10 are necessary to operate an engine. The shafts 11 along with the gears 10 and cams 12 may be moved over slightly to one side that will allow clearance for the piston rods which may extend from rollers 6. Also, if desired, one or each of these rods may be replaced with a pair of rods which oscillate inside a V-type cylinder arrangement. Cylinder 2 may be replaced with two V-shaped cylinders which each carry two pistons with rods and each have a combustion chamber placed approximately in their centers and between each pair of pistons. Another possibility is to have rods extend from the ends of the rocker levers 5 outwardly from cylinder 2. These rods will operate with two outer cylinders, and cylinder 2 may operate between them. This would arrange four pistons close together and provide smoother torque. This cylinder arrangement will cause the rollers 6 to slip more which can be prevented by use of gears to mesh cams 6 and 12 with separate rollers 6 or which can be greatly reduced by using specially constructed light rollers 6 and applying only low piston speeds. Cams 12 may make contact with both rollers 6 and rocker levers 5 alternately which would only make the engine slightly smaller, or cams 12 may make contact with only the rollers 6 in place of the rocker levers 5. In this case, as discussed above, there may be more than one or separate roller 6 placed in line, and one or more roller 6 will make contact with cam 7, and one or more separate roller 6 will make contact with cam 12. Because cam 7 will make contact with a different roller or rollers than cam 12 will make contact with, then each cam 7 and 12 will maintain a separate roller 6 speed which will prevent unnecessary rollers 6 slippage and frictional losses. This is the best system for the four-stroke engines, and a good system for the two-stroke engine. The cams 12 making contact with the rocker levers 5 is also a good system for the two-stroke engine. Another possibility is to have cams 12 designed larger around and moved a little distance outward so that its contact speed is about the same as rollers 6 when the pistons approach top center position. Three gears connecting shaft 8 with shaft 11 will make the bearing surfaces move in the same direction while making contact. This design would require more space. Similar to some conventional engines, this invention may have one or more banks or series of meshing gears that will operate with one or more engine banks or series. When an engine operates with more than one gear bank, then each of these gear banks will be placed into a separate plane that is parallel to and in line with the other banks, and these banks of gears are connected to the same parallel shafts that may support one or more banks of cams that are parallel and spaced apart and each of these banks of cams are a part of a separate engine series which carries one or more cylinders. Because the shafts may be readily designed to be very strong or rigid, it is possible to have one gear bank operate many engine series or banks. This invention will have mechanical efficiencies that range from 90 percent to 97 percent, and this would include either the two- or four-stroke engines. When using the conventional crankshaft, the two-stroke engine using crankcase compression may have as high as 25 percent piston frictional losses in comparison to about 12 percent when using the four-stroke engine. Piston friction has been the most important factor in the elimination of the two-stroke for many applications. Also another factor, which is important, is that the pistons of a four-stroke crankshaft engine are more easily cooled. Because the engine designs of the invention operate more efficiently, then they will also operate cooler; and this will prevent the pistons cooling complication in which the two-stroke engines have had when using the conventional crankshaft. For aircraft two-stroke engines with exhaust valves in the engines heads are recommended because of the lighter oscillating parts which will cause less fourth-order torque variation, and also the smaller two-stroke cylinders will provide more space and are more accessible. The two-stroke aircraft engine may use air cooling for up to about 8 inch diameter cylinder bores, and over 8 inch diameter cylinders may use water cooling in combination with air cooling. This invention may use the two-stroke engine for all applications. Some applications in which the four-stroke would be about as advantageous as the two-stroke crankcase compression engine are automobiles, trucks, buses, boats, stationary engines and earth-moving equuipment. The two-stroke turbo-supercharge engines will have over a 5 percent advantage in fuel economy over the four-stroke engines. It is to be understood that the embodiments shown in the drawings and described above are given merely for the purpose of explanation and illustration without intending to limit the scope of the claims to the specific details enclosed.

I claim:

1. A two-stroke internal combustion engine, comprising:

a block, cylinder means carried by said block, two pistons supported in said cyliner means for reciprocal movement in opposite directions, a piston rod connected to each piston, two rocker levers, each having first and second ends, each rocker lever being pivotally connected to said block for pivotal movement about a pivot axis between its first and second ends, said pivot axes of said two rocker levers being spaced from each other, the first ends of said rocker levers being pivotally connected to said piston rods respectively whereby reciprocal movement of said piston rods causes said rocker levers to rock back and forth, a rotatable main cam connected to a main shaft carried by said block, said main cam causing said main shaft to rotate upon rotation of said main cam, said main cam being located between said second ends of said rocker levers, rollers connected to said second ends of said rocker levers for engaging said main cam for causing said main cam to rotate upon reciprocal movement of said pistons, a main gear coupled to said main shaft for rotation therewith, secondary shafts carried by said block on opposite sides of said main gear, said secondary shafts and said main shaft being in line with each other, secondary gears coupled to said secondary shafts and having teeth meshing with the teeth of said main gear whereby rotation of said main gear causes rotation of said secondary gears and hence said secondary shafts, secondary cams connected to said secondary shafts for rotation therewith for engaging said rocker levers for causing said rollers to engage said main cam, and flexible diaphragm means located to seal said cylinder means from said cams and gears and actuated by movement of said rocker levers.

* * * * *